United States Patent [19]

Liebert

[11] Patent Number: 4,946,151

[45] Date of Patent: Aug. 7, 1990

[54] COMBINED FOLDED SUBSTRATE TRANSFER AND SPEED MATCHING APPARATUS

[75] Inventor: Oskar Liebert, Neusäss, Fed. Rep. of Germany

[73] Assignee: MAN Roland Druckmaschinen AG, Offenbach am Main, Fed. Rep. of Germany

[21] Appl. No.: 251,541

[22] Filed: Sep. 29, 1988

[30] Foreign Application Priority Data

Oct. 17, 1987 [DE] Fed. Rep. of Germany ..... 3735303

[51] Int. Cl.[5] ..... B42C 1/00

[52] U.S. Cl. ..... 270/47; 270/21.1; 270/49; 270/50

[58] Field of Search ..... 270/21.1, 32, 45, 47, 270/48, 49, 50, 51, 60, 5, 6–9

[56] References Cited

U.S. PATENT DOCUMENTS

| | | | |
|---|---|---|---|
| 4,260,144 | 4/1981 | Trutschel | 270/47 |
| 4,381,106 | 4/1983 | Laebach | 270/47 |
| 4,564,183 | 1/1986 | Muller | 270/21.1 |

FOREIGN PATENT DOCUMENTS

| | | | |
|---|---|---|---|
| 2449629 | 4/1976 | Fed. Rep. of Germany . | |
| 2307743 | 11/1976 | France | 270/21.1 |
| 58-135065 | 8/1983 | Japan | 270/47 |

*Primary Examiner*—Edward K. Look
*Assistant Examiner*—Therese M. Newholm
*Attorney, Agent, or Firm*—Frishauf, Holtz, Goodman & Woodward

[57] ABSTRACT

To match the speed of a folding flap cylinder (12) folding sheets cut from a web in half to a slower speed of a gripper chain delivery system (17, 18), a transfer cylinder (15) with grippers (16) is provided which operates at a circumferentially non-uniform speed (FIG. 3, curve 30), in which the speed of the transfer cylinder (15), when receiving a sheet from the folding flap cylinder (12), is essentially synchronous therewith, and then decelerates to be essentially synchronous with the speed of the gripper chain delivery system (17), for subsequent acceleration to the speed of the folding flap cylinder. The circumferentially non-uniform speed is obtained by driving the transfer cylinder (15) through a worm transmission in which the worm has a non-uniform pitch or non-uniform angle of inclination of the worm groove or the respective worm lands defining the groove.

20 Claims, 3 Drawing Sheets

COMBINED FOLDED SUBSTRATE TRANSFER AND SPEED MATCHING APPARATUS

Reference to related application, assigned to the assignee of the present invention, the disclosure of which is hereby incorporated by reference: U.S. Ser. No. 07/227,368, filed Aug. 2, 1988, Fischer Reference to related publications: German Patent Disclosure Document DE-OS No. 24 49 629, to which British Patent No. 747,444 corresponds.

The present invention relates to a combined folded substrate transfer and speed matching apparatus, and more particularly to a folding apparatus having a folding flap cylinder to supply folded substrate sheets, for example printed sheets or groups of sheets received from a printing machine, and deliver the folded substrate sheets to a delivery system, in which the delivery system operates at a speed which is different from the speed of the supply system, and, typically, slower than the speed of the supply system.

BACKGROUND.

The invention is particularly applicable to the combination of a folding flap cylinder, having folding flaps or grippers, with a delivery system having delivery chains likewise supplied with grippers.

British Patent No. 747,444 describes a folding apparatus in which the folded substrates are received from the folding flap cylinder by a transfer cylinder which has grippers, for supply to a belt system which operates at a lower speed than the circumferential speed of the transfer cylinder. The circumferential speed of the transfer cylinder is above the speed of the receiving belt system, and is reduced with respect to the surface speed of the folding flap cylinder by about 35%. The folded products are thus transferred from the folding flap cylinder and the transfer cylinder under conditions in which the speed of the transfer cylinder is substantially different from the surface speed of the folding flap cylinder. This results in compression and crushing of the sheets at the ends from time to time. Damage to the sheets at those end portions which are to be gripped by the grippers is unavoidable. When the folded products are transferred to the belts, they are transferred in irregular intervals thereon which interferes with smooth operation of subsequent units coupled to the delivery belts for further handling of the substrates.

THE INVENTION

It is an object to provide an apparatus capable of transferring folded substrates while, at the same time, matching the speeds, and more particularly to a folding apparatus in which folded substrates are received from a folding flap cylinder at one speed and delivered to a transport chain system, with grippers, operating at a slower speed, while handling the substrates gently, and providing precise spacing between the folded substrates at the delivery belt.

Briefly, a transfer cylinder is provided which is coupled to a drive system to rotate the transfer cylinder, the drive system rotating the transfer cylinder at a circumferentially non-uniform speed such that, at the time of receiving transfer of folded sheets to the cylinder, for example from a folding flap cylinder, the speed thereof is essentially synchronous with the speed of the folding flap cylinder; at the time of delivery transfer of the folding sheets from the transfer cylinder, the speed is retarded to be essentially synchronous with a second speed, corresponding to the speed of the receiving element, typically a gripper chain.

The system has the advantage that the circumferentially non-uniform drive of the transfer cylinder permits transfer of folded sheets from the folding flap cylinder to a delivery system at the synchronous speed at which the sheets operate at the time of the respective transfer. This effectively eliminates damage to the edge of the sheets gripped by the grippers.

The delivery system, preferably, is a gripper chain, that is, a chain system having grippers on which the grippers are spaced from each other by predetermined distances. Thus, precise positioning of the folded products is obtained. Other apparatus for further document handling may be used.

Figure 1:
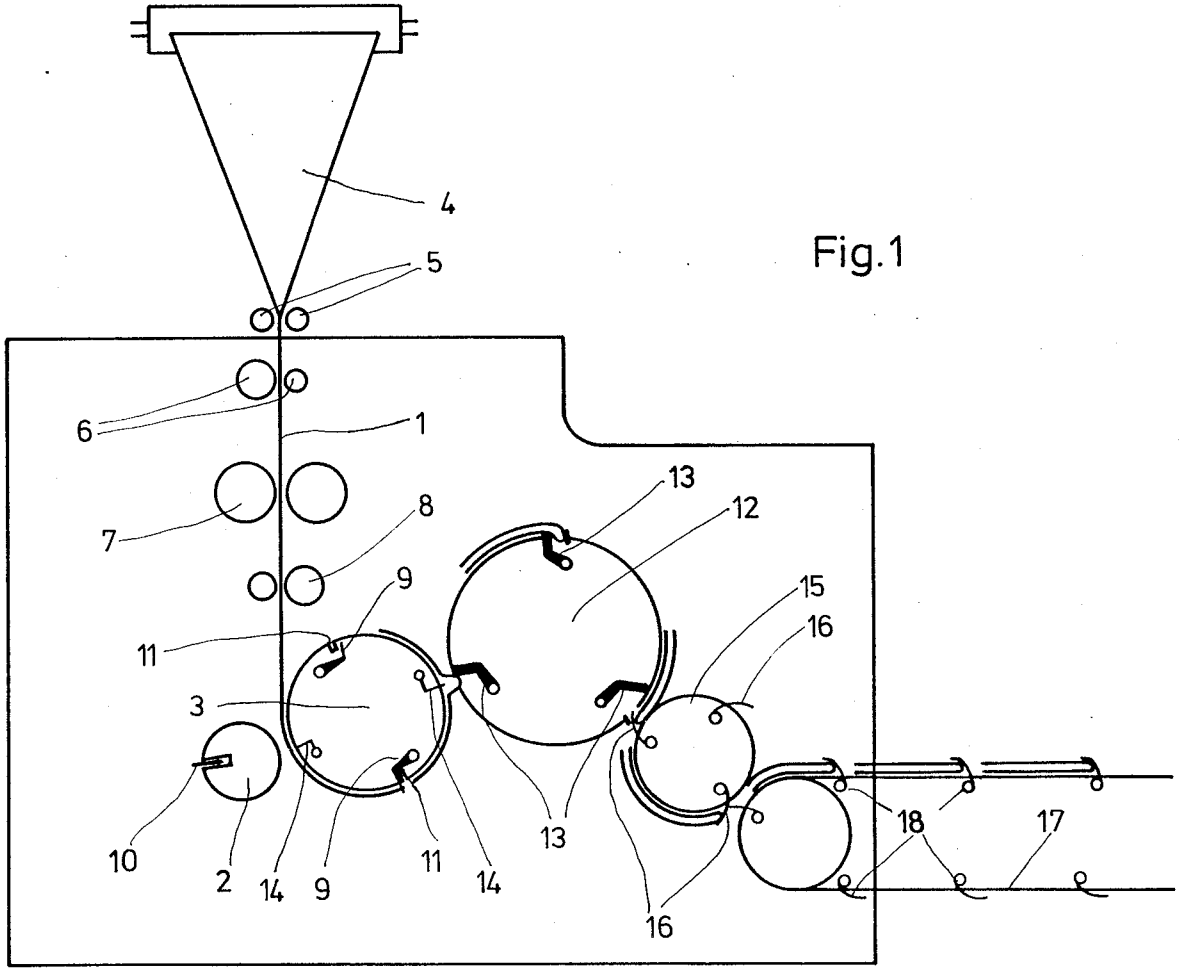
FIG. 1 is a schematic side view of a folding apparatus in which sheets are transferred from a folding flap cylinder to a gripper chain system.

DETAILED DESCRIPTION.

A paper web 1 is guided between a cutting knife cylinder 2 and a folding blade cylinder 3. Other apparatus in advance of this system do not form part of the present invention and are shown only schematically to illustrate association of the system of the present invention with a printing machine. In the example selected, an endless web is guided over a folding triangle or folding former 4, pulled downwardly by pulling and runout rollers 5, through a further pair of pulling rollers 6, then past transverse perforating cylinders 7 and through another pair of pulling rollers 8. The folding blade cylinder has gripping needles or punctures 9 at its circumference, which penetrate through the paper web 1 at the leading edge and guide the paper web around the circumference of the folding blade cylinder 3. The cutter knife cylinder 2 has a knife 10 thereon which, at each rotation thereof, penetrates into a groove 11 opposite the knife 10, and formed in the folding blade cylinder 3. Thus, the web 1 is cut into sheets of equal lengths. Looked at in the direction of rotation of the folding blade cylinder 3, a further pair of penetrating needles 9 is immediately located behind each groove which holds the web already before being separated in the respective cut portions so that the thus cut sheets will be held at their leading edge.

A portion of the web, severed from the web 1, is held by the needles 9 and guided about the folding blade cylinder 3. A folding flap or folding groove cylinder 12 is associated with the folding blade cylinder 3. It is formed at its circumference with a plurality of uniformly spaced folding grooves or folding flaps 13 which form a transverse fold upon projection of a folding blade 14 located, prior to projection, in the interior of the folding blade cylinder 3, and radially movable outwardly. The sheet cut from the web, and forming a web portion, is held in the folding flap 13 and, as held therein, will have a length wrapping around the folding flap cylinder 12 which is half that of the length around the folding blade cylinder 3. The diameter and the speeds of the cylinders 2, 3 and 12 are so matched to each other that the three cylinders will have the same circumferential speed.

A transfer cylinder 15 is associated with the folding cylinder 12. The transfer cylinder 15 has a plurality of grippers 16 thereon, which are uniformly spaced from each other, and the number of which corresponds to the number of sheets to be transferred thereto. A delivery chain 17, with grippers 18 thereon, is associated with the transfer cylinder 15. The delivery chain 17 operates at a speed which is less than the circumferential speed of the folding flap cylinder 12. The grippers 18 are uniformly spaced along the length of the chain 17, which can be an endless chain, and they receive the folded sheets from the transfer cylinder 15.

Gripper systems which are capable of taking folded substrate elements from a folding flap cylinder are well known in the paper handling, and particularly printing machine industries. Such units have been used in industry for a long time; for example, they are available as special equipment to generate a second transverse fold or a delta fold in machines manufactured by the assignee of the present application and sold under the Registered Trademark LITHOMAN. Since grippers and transfer chains are well known in the industry, no further description is necessary.

In accordance with the present invention, reception of folded substrates from the folding flap cylinder 12 and delivery thereof to the gripper chain 17 at a second, and lower speed, is accomplished by driving the transfer cylinder 15 with a circumferentially non-uniform speed. This drive is so arranged that the cylinder 15 will have an effectively instantaneous speed which is essentially in synchronism with the folding flap cylinder 12 upon receiving the sheets and will be essentially in synchronism with the gripper chain 17 upon delivering the sheets thereto.

Figure 2:
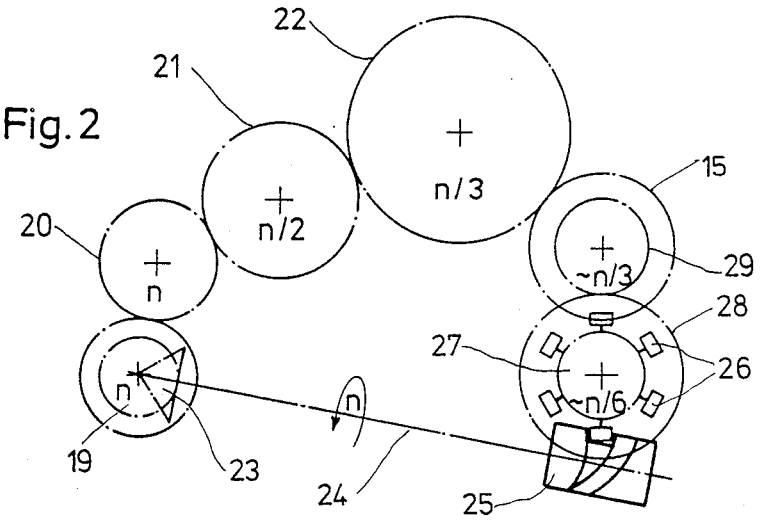
FIG. 2 is a schematic diagram of a drive for the transfer cylinder.

FIG. 2 illustrates a preferred embodiment of a drive which is circumferentially non-uniform. A main drive shaft of a printing machine, not further shown, drives a gear 19 which, in turn, drives a gear 20. Gear 20 drives the cutter cylinder 2. The gears 19 and 20 operate at nominal machine speed, which is indicated in FIG. 2 by the notation n. A gear 21, secured to the shaft of the folding flap cylinder 3, has twice the circumference, and twice the number of gear teeth than the gear 20, and thus operates at half machine speed, as indicated in gear 21 by n/2.

A third gear 22 is coupled to the shaft of the folding flap cylinder 12 which, with respect to gear 21, has 1.5 times the number of teeth, or circumference, as the gear 21, so that the folding flap cylinder 12 operates at one-third of the machine speed, that is, at n/3.

Gear 19 is further coupled via a right-angle drive 23 to a shaft 24 which rotates at normal machine speed n. Shaft 24 is securely coupled to a worm 25. The flanks of the worm have non-uniform pitch or angle of inclination. Follower rollers 26, secured to a carrier disk 27, are in engagement with the grooves of the worm, so that, in dependence on the non-uniform pitch or inclination of the worm 25, the follower rollers transfer their movement, circumferentially non-uniformly to a gear 28 which, in turn, meshes with a gear 29 coupled to the shaft of the transfer cylinder 15.

As shown in FIG. 2, the disk 27 has six circumferentially uniformly distributed follower rollers 26 secured thereto. If the worm 25 has a single worm track, the disk 27 and the gear 28 coupled thereto will, averaged about a revolution, operate with one-sixth of machine speed, that is, n/6. The gear 29 on the shaft of the transfer cylinder 15 is coupled to the gear 28 in such a manner that the speed of the gear 29 is reduced by half, since gear 28 has twice the circumference or the number of teeth as gear 29. Thus, the transfer cylinder 15 will operate, averaged, at one-third of machine speed, that is, average n/3.

In a particularly preferred embodiment, the worm 25 and the disk 27 are so associated with each other that two of the follower rollers 26 engage at the two flanks or sides of a worm groove or worm tooth. This ensures quiet operation of the drive.

Figure 3:
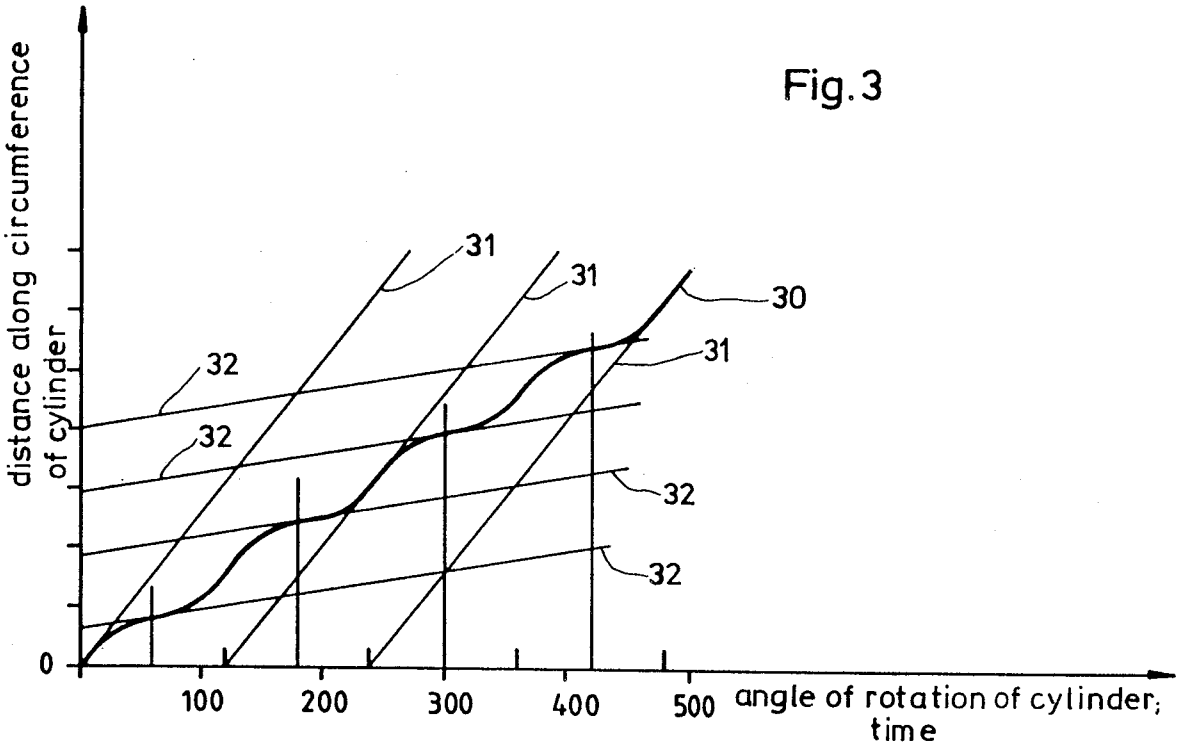
FIG. 3 is a distance vs. angular position of the cylinder, thus providing speed curves of the respective components of the drive system.

Operation, with reference to FIG. 3: The non-uniform inclination or pitch of the worm or worm tooth element 25 causes movement of the transfer cylinder 15 which is circumferentially non-uniform, and as illustrated in the diagram in FIG. 3 by curve 30. In this diagram, the angle of rotation of the respective cylinders and the associated path at the circumference of the cylinder is likewise shown by a plurality of parallel straight lines 31 which, in the present example, are uniformly spaced from each other by a spacing of 120°, and represent the movement of the respective folding flap systems 13 on the folding flap cylinder 12. The parallel lines 32, which extend at a lesser slope than the lines 31, illustrate the movements of the grippers 18 on the gripper chain 17. As seen in FIG. 3, the surface speed or circumferential speed of the transfer cylinder 15, represented by the curve 13, oscillates between the maximum speed of the surface speed of the folding flap cylinder 12 and a minimum speed which corresponds to the operating speed of the grippers 18 on the gripper chains 17. This oscillation is uniform and repeats continuously.

The folding flap cylinder 12 and the transfer cylinder 15 contain the same number of uniformly circumferentially located folding flaps 13 or grippers 16, respectively. In the present example, three folding flaps 13 and three grippers 16 are provided. Two each adjacent grippers include an angle $\phi$. The receiving transfer position at the transfer cylinder 15, in which a folded sheet is received from the folding cylinder 12 and the delivery transfer position, in which a folded sheet is transferred to the chain 17, are offset by a single or odd multiple of half of this angle $\phi$, that is, by $\phi/2$ with respect to each other. Receiving transfer and delivery transfer positions, in the example selected, are offset by 180°, that is, by three times $\phi/2$. Other arrangements likewise are possible, using an offset by $1 \cdot \phi/2 = 60°$ or $5 \cdot \phi/2 = 300°$, or, in general, by m $\phi/2$, wherein m is 1, 3, 5.

The arrangement readily permits matching the instantaneous circumferential speed of the transfer cylinder to the respective first and second speeds of the folding flap cylinder and of the chain system 17. The respective spacing, then, results in maximum spacing of the maximum and minimum speeds at the transfer cylinder 15, thereby minimizing the required acceleration and deceleration to obtain the maximum and minimum speeds of the transfer cylinder 15.

Various changes and modifications may be made within the scope of the inventive concept.

What is claimed:

1. Combined folded substrate transfer and speed matching system, for foled substrate sheets, wherein said sheets are received at a first speed and positively delivered and removed at a second speed differing from said first speed, comprising means (12) for supplying the folded sheets at a first speed;

means (17, 18) for removing the folded sheets at a second speed;

a transfer cylinder (15) transferring the sheets from said supply means (12) to said removal means (17, 18);

grippers (16) located on the transfer cylinder for gripping the folded substrate sheets; and a drive system for rotating the transfer cylinder, said drive system (24, 27) rotating the transfer cylinder (15) at a circumferentially non-uniform speed in which, at the time of receiving of the folded sheets by the grippers (16) of said transfer cylinder and transfer of the sheets thereof, the transfer cylinder is rotating at a speed which is essentially synchronous with said first speed and, at the time of delivery to and positive transfer of the folded sheets from the grippers of said transfer cylinder, the transfer cylinder is rotating at a speed which is essentially synchronous with said second speed of the sheet removal means to provide for positive transfer of the sheets from said grippers (16) on the transfer cylinder (15) to said sheet removal means (17, 18) at predetermined positions thereon.

2. The system of claim 1, wherein said first speed is higher than said second speed.

3. The system of claim 1, wherein said folded sheet supply means includes a folding flap cylinder (12) delivering said sheets for transfer to the transfer cylinder (15) at said first speed.

4. The system of claim 1, wherein said folded sheet removal means includes a gripper chain system (17, 18) receiving the sheets from said transfer cylinder (15) at said second speed.

5. The system of claim 1, wherein said folded sheet supply means includes a folded flap cylinder (12) delivering said sheets for transfer to the transfer cylinder (15) at said first speed; and wherein said folded sheet removal means includes a gripper chain system (17, 18) receiving the sheets from said transfer cylinder (15) at said second speed.

6. The system of claim 5, wherein said folding flap cylinder (12) operates at a speed which is higher than the speed of said gripper chain system.

7. The system of claim 1, wherein said folded sheet supply means includes a folding flap cylinder (12) delivering said sheets for transfer to the transfer cylinder (15) at said first speed;

a plurality of gripper systems (13) located on the folding flap cylinder (12);

wherein the folded sheets are received from the folding flap cylinder by said transfer cylinder (15) at a receiving position and delivered by said transfer cylinder for delivery transfer at a delivery position;

and wherein said receiving positions and delivery positions are offset from each other by half of the angle ($\phi$) of two adjacent gripper systems (16) on the transfer cylinder, or an odd multiple thereof comprising 3 or 5.

8. The system of claim 1, wherein said drive system (24–27) comprises a worm (25) having non-uniform pitch or inclination;

a carrier disk (27) and a plurality of engagement rollers (26) secured to the carrier disk and in engagement with a groove or cam track on said worm (25).

9. The system of claim 8, wherein the number of follower rollers (26) is so selected that two follower rollers are in engagement with the two flanks of a worm groove or worm land or tooth defining the worm groove therebetween.

10. The system of claim 8, wherein said folded sheet supply means includes a folding flap cylinder (12) delivering said sheets for transfer to the transfer cylinder (15) at said first speed;

a plurality of gripper systems (13) located on the folding flap cylinder (12);

wherein the folded sheets are received from the folding flap cylinder by said transfer cylinder (15) at a receiving position and delivered by said transfer cylinder for delivery transfer at a delivery position;

and wherein said receiving positions and delivery positions are offset from each other by half of the angle ($\phi$) of two adjacent gripper systems (16) on the transfer cylinder, or an odd multiple thereof comprising 3 or 5.

11. The system of claim 10, wherein said folding flap cylinder (12) operates at a speed which is higher than the speed of said folded sheet removal means.

12. The system of claim 8, wherein said folded sheet supply means includes a folding flap cylinder (12) delivering said sheets for transfer to the transfer cylinder (15) at said first speed; and wherein said folded sheet removal system includes a gripper chain system (17, 18) receiving the sheets from said transfer cylinder (15) at said second speed.

13. The system of claim 12, including a plurality of gripper systems (13) located on the folding flap cylinder (12);

wherein the folded sheets are received from the folding flap cylinder by said transfer cylinder (15) at a receiving position and delivered by said transfer cylinder for delivery transfer at a delivery position;

and wherein said receiving positions and delivery positions are offset from each other by half of the angle ($\phi$) of two adjacent gripper systems (16) on the transfer cylinder, or an odd multiple thereof comprising 3 or 5.

14. The system of claim 12, wherein said folding flap cylinder (12) operates at a speed which is higher than the speed of said gripper chain system.

15. The system of claim 13, wherein said drive system (24–27) comprises a worm (25) having non-uniform pitch or inclination;

a carrier disk (27) and a plurality of engagement rollers (26) secured to the carrier disk and in engagement with a groove or cam track on said worm (25).

16. The system of claim 15, wherein the number of follower rollers (26) is so selected that two follower rollers are in engagement with the two flanks of a worm groove or worm land or tooth defining the worm groove therebetween.

17. The system of claim 1, wherein said transfer cylinder (15) comprises a gripper cylinder wherein, upon receiving the folded sheets from said folded sheet supply means, the grippers (16) thereof grip said sheets while the transfer cylinder (15) is instantaneously rotating at said first speed;

and wherein, upon delivery of the folded sheets and positive transfer thereof from said transfer cylinder to said sheet removal means, the grippers release said sheets while the transfer cylinder (15) is instantaneously rotating at said second speed.

18. The system of claim 1, wherein the sheet removal means comprises transport means (17) and means (18) for positively positioning said sheets on said transport means at predetermined locations thereof.

19. The system of claim 2, wherein the sheet removal means comprises transport means (17) and gripper means located on said transport means and positively positioning the sheets on the transport means, the gripper means on the transport means receiving the sheets from the grippers (16) on the transfer cylinder while the transfer cylinder is instantaneously rotating at said second speed of the transport means (17).

20. The system of claim 11, wherein the sheet removal means comprises transport means (17) and gripper means located on said transport means and positively positioning the sheets on the transport means, the gripper means on the transport means receiving the sheets from the grippers (16) on the transfer cylinder while the transfer cylinder is instantaneously rotating at said second speed of the transport means (17).

* * * * *